United States Patent [19]

Gherardi

[11] 4,225,032

[45] Sep. 30, 1980

[54] DEVICE FOR REMOVING ROD-LIKE ARTICLES FROM A HOPPER

[75] Inventor: Gianluigi Gherardi, Medicina, Italy

[73] Assignee: CIR S.p.A. - Divisione Sasib, Bologna, Italy

[21] Appl. No.: 3,956

[22] Filed: Jan. 16, 1979

[30] Foreign Application Priority Data

Jan. 23, 1978 [IT] Italy ..... 12436 A/78

[51] Int. Cl.[3] ..... B65G 47/12

[52] U.S. Cl. ..... 198/443; 198/447; 198/481; 198/493; 198/550

[58] Field of Search ..... 198/418, 443, 445, 447, 198/480, 481, 493, 540, 550, 551, 562, 567, 455, 616, 689, 441, 438, 483, 484; 131/25; 221/211

[56] References Cited

U.S. PATENT DOCUMENTS

| | | | |
|---|---|---|---|
| 2,376,651 | 5/1945 | Bardet | 198/418 |
| 2,466,962 | 4/1949 | Weymouth | 198/441 |
| 2,787,359 | 4/1957 | Gerecke | 198/483 |
| 3,042,183 | 7/1962 | Ackley | 198/443 |
| 3,715,056 | 2/1973 | Preston | 221/211 |
| 3,854,567 | 12/1974 | Povpin et al. | 198/689 |
| 4,073,372 | 2/1978 | List | 198/447 |

FOREIGN PATENT DOCUMENTS

| | | | |
|---|---|---|---|
| 518471 | 2/1931 | Fed. Rep. of Germany | 198/445 |

*Primary Examiner*—Joseph E. Valenza
*Attorney, Agent, or Firm*—Spencer & Kaye

[57] ABSTRACT

The device for the removal of rod-like articles from a hopper in which a bulk supply of articles is provided and a rotating fluted drum is arranged to form the bottom wall of the hopper so that the articles are removed from the hopper by being picked by the flutes of the drum, presents the feature that each flute of the rotating drum has a depth so as to be capable of housing at least two superposed articles. The flutes filled with the articles come out of the hopper zone and a stripper takes out from each flute just one article, while the other article, if two of them were present in the flute, is again inserted in the operational cycle of the flute.

5 Claims, 5 Drawing Figures

B
2
3
B1
B2
101
Z
1
5
6
4

DEVICE FOR REMOVING ROD-LIKE ARTICLES FROM A HOPPER

BACKGROUND OF THE INVENTION (1) Field of the Invention

The present invention relates to a device for removing rod-like articles such as filter plugs for filter cigarettes from a hopper in which a bulk supply of said rod-like articles is provided. In the manufacture of filter cigarettes, a bulk supply of filter plugs is provided in a hopper, and a rotating fluted drum is arranged to form a wall of the hopper so that a filter plug is removed from the hopper in each flute of the drum. The filter plugs thus removed are transferred by transfer means to feeding conveyers which feed them to further processing machines such as a cigarette maker. Upon increase of the operational speeds, and consequent increase of the speed at which the flutes pass through the hopper, it becomes more difficult to ensure that each flute picks up a filter plug as it passes through the hopper. It is evident that if some flutes of the drum are empty, the output of the apparatus receiving the filter plugs (for example a cigarette making machine) is correspondingly reduced.

(2) Statement of the Prior Art

In accordance with 37 CFR 1.56, applicant states that the following prior art is the closest prior art known:

U.S. Pat. No. 3,715,056 (Preston): the whole document.

U.S. Pat. No. 3,253,491 (Rakowicz): FIG. 1, column 4, lines 10–21.

U.S. Pat. No. 4,073,372 (List): FIG. 1.

SUMMARY OF THE INVENTION

The present invention contemplates a device of the type referred to above, in which cigarette filter plugs (or other rod-like articles) are contained in a hopper, said hopper being closed at its bottom by a drum rotating on a horizontal axis and presenting a plurality of peripheral flutes parallel to its axis, transfer means (such as a mechanical stripper) being provided at a point of the circumferential path of the drum outside of the hopper, for transferring the filter plugs housed in the flutes to a feed conveyer operatively coupled to the rotating drum. The characterizing feature of the invention resides in the fact that each flute of the drum presents a depth so as to be capable of housing at least two filter plugs arranged parallel to each other and the one above the other in radial direction, while the transfer means take out at least one filter plug from each flute and transfer it to the feed conveyer. According to a preferred embodiment, each flute of the drum can house two filter plugs, while the transfer means take out just one plug. It appears evident that the probabilities that an empty flute comes out of the hopper are greatly reduced. If the flute is filled with two superposed plugs, the transfer means will take out of the flute just the outermost plug, while the innermost plug will be again inserted in the operative cycle of the flute, which will enter again in the hopper zone; if the flute houses just one plug, the transfer means will take out the said single plug, and the empty flute will again enter in the hopper zone to receive at least another plug.

With respect to the device disclosed in the U.S. Pat. No. 3,715,056 to Preston, the device according to the present invention presents the advantage that no suction is applied in correspondence of the bottom of the flutes, while the flutes are in the hopper zone, in order to attract the plugs in the flutes. The said suction, combined with the weight of the bulk of plugs above the plugs in the removal zone (the bottom wall zone, closed by the rotating drum), could damage the plugs picked up by the flutes. According to the invention, the flutes become filled with plugs which tend to get into the flutes due to their own gravity and to the weight of the mass of the overlying plugs, and no suction forces, which may lead to violent impacts of the plugs into the flutes, are present in the hopper region.

The above and other features of the invention will appear evident from the following description of some preferred embodiments of same, made with reference to the attached drawings.

DESCRIPTION OF SOME PREFERRED EMBODIMENTS

Figure 1:
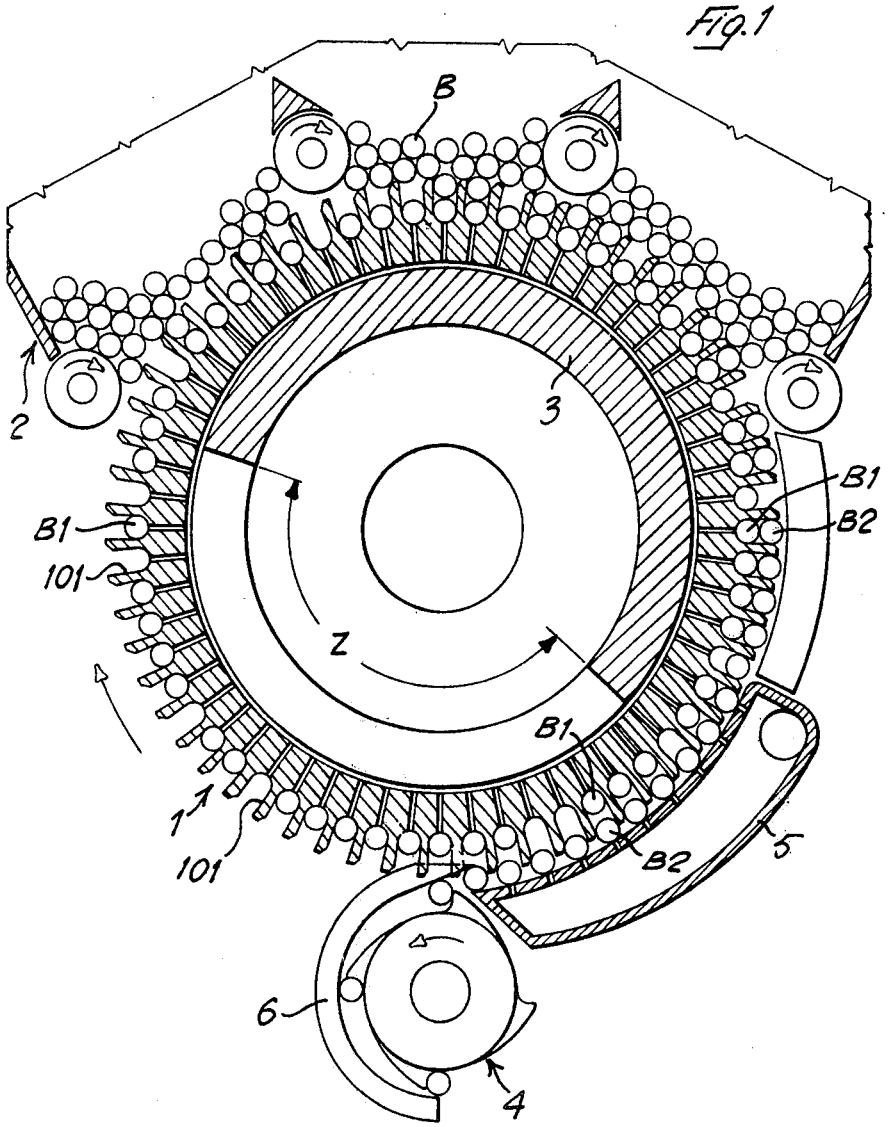
FIGS. 1 to 4 show, in side section, as many different embodiments of a removal device according to the invention.

With reference to FIG. 1, the rod-shaped articles, such as filter plugs B, are fed into a hopper 2 by any suitable means and are removed from the hopper by a fluted drum 1, a portion of said drum 1 forming the bottom wall of the hopper 2. Each flute 101 of the fluted drum 1 presents a depth calculated in such a manner as to permit the housing, in the said flute, of two superposed filter plugs B1, B2 arranged parallel to each other and the one above the other in radial direction. The drum 1 rotates in the direction shown by the arrow.

The flutes 101 are provided with apertures through which suction is applied in order to maintain the innermost filters B1 into the flutes, along a fixed arc Z which is located outside of the portion of the drum forming the bottom wall of the hopper 2. Suction is applied to the apertures in the flutes 101 by means of a conventional type stationary valve arranged at the interior of the drum 1, where suction is provided, said stationary valve presenting a fixed cylindrical wall 3 presenting a cut away portion which extends precisely along the length of the said arc Z.

During the rotation of drum 1, the flutes 101 are filled with at least one filter plug B. The thus filled flutes 101 then come out of the hopper and the filter plugs B1, B2 are maintained at the interior of the flutes by conventional curved guide means, until the flutes 101 reach a zone where a concave suction guide 5 is provided, presenting a concave surface with apertures where suction is applied, so as to draw against the said suction guide 5 the outermost filter plug B2 (or the single filter plug, should the flute contain just one plug). Shortly after the beginning of the outward suction zone provided by the concave suction guide 5, there begins the inward suction zone of arc Z, whereby the innermost filter plug B1 is held at the bottom of its flute 101. If the flute 101 after having passed along the bottom zone of the hopper 2 was filled with just one plug, the said plug, as above mentioned, has been previously attracted by the suction guide 5, and therefore the bottom of the flute will remain empty. At the end of the concave suction guide 5 there are provided transfer means, such as a mechanical stripper 6, which removes the outermost plugs in cooperation with a feed drum 4 and feeds them to subsequent processing.

The innermost plug B1 is maintained at the bottom of flute 101 for the remainder of arc Z up to the beginning of hopper 2, or shortly before same. In this manner, when the flutes 101 again enter in the hopper zone, some of them already contain a filter plug, which will become the innermost filter plug B1, if another filter plug B2 comes to fill the flute during the movement of the flute over the arc covering the bottom portion of the hopper 2.

Figure 2:
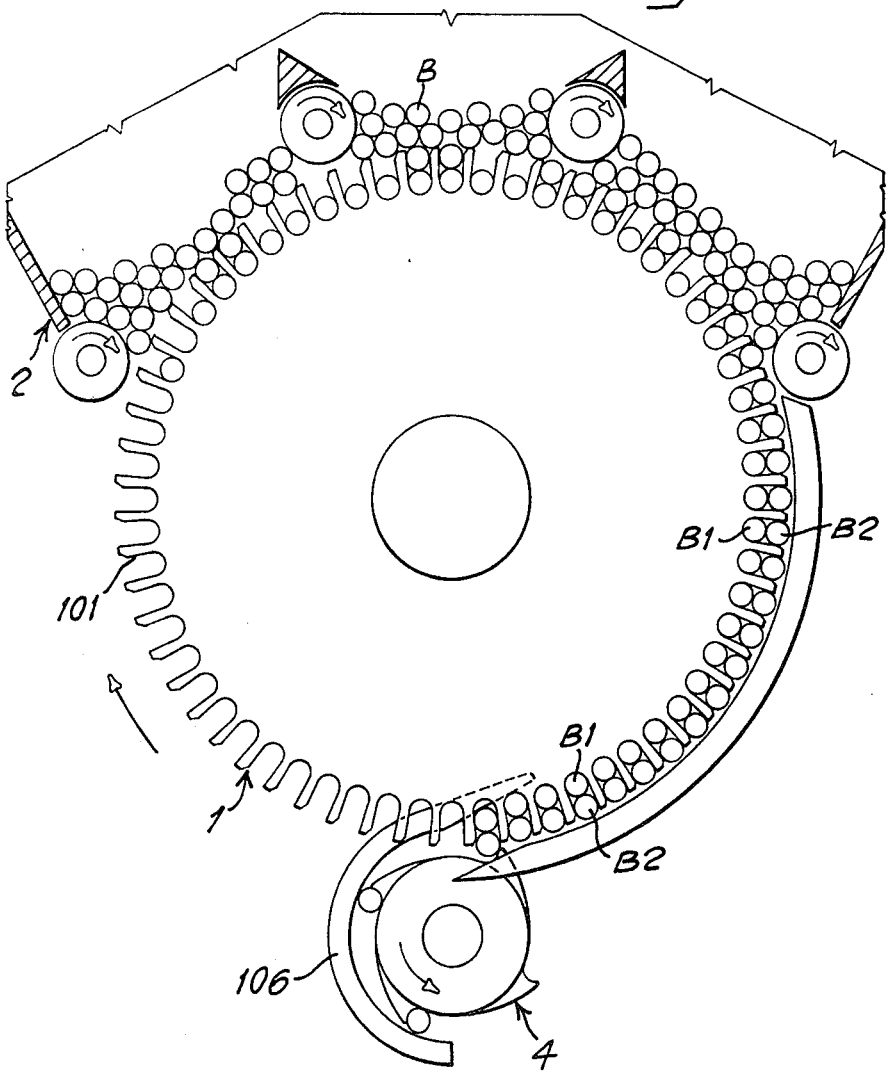

Referring to FIG. 2, there is shown an embodiment in which the mechanical stripper 106 removes both filter plugs B1, B2 from each flute 101, and the feed drum 4 takes the said plugs individually the one after the other (the outermost plug B2 is taken first, and then the innermost plug B1). It will be appreciated that, by maintaining unvaried the speed of feed drum 4, the angular speed of drum 1 will be reduced to half the speed of the embodiment shown in FIG. 1. Therefore the flutes 101, during their slower passage at the interior of hopper 2, will be certainly loaded with two superposed filter plugs B1, B2.

Figure 3:
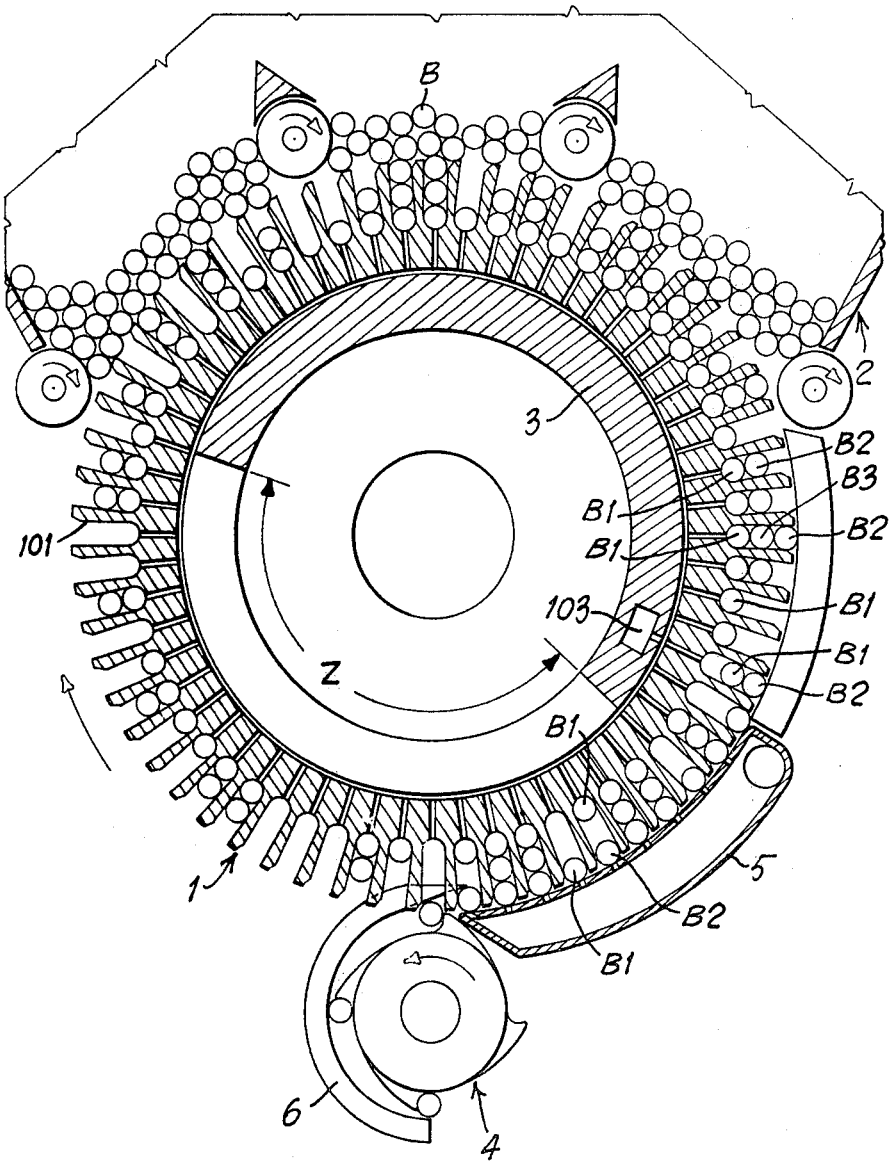

In FIG. 3 there is shown another embodiment, in which each flute 101 of drum 1 presents a depth to accomodate three superposed filter plugs. The device is provided with a stationary valve arrangement for providing suction in the flutes in correspondence of an arc Z, and with a concave suction guide 5, as illustrated in connection with the embodiment of FIG. 1. Shortly before the end of the valve wall 3 (in the direction of rotation of drum 1) there is obtained, in the said wall 3, a blow duct 103 which presents an aperture in such a manner that the apertures obtained at the bottom of each flute 101, during the rotary movement of drum 1, come to register subsequently with the said aperture of blow duct 103. At the interior of said blow duct 103 there is maintained a suitable air pressure.

The operation of the just described embodiment is the following, having regard to three possible situations:

(a) The flute 101 comes out of the hopper zone having picked just one filter plug B1: in this case, when the aperture in the flute registers with the aperture of the blow duct 103, an air blow pushes the said filter plug B1 towards the exterior, so that same is caused to adhere against the surface of suction guide 5, and it is not subjected to the inwardly directed suction in correspondence of the arc Z. The filter plug B1 is then removed by the stripper 6 and taken by feed drum 4.

(b) In the flute 101 coming out of hopper 2 there are two filter plugs B1 (innermost) and B2 (outermost): when the aperture in the flute registers with the aperture of the blox duct 103, the air blow pushes both plugs towards the exterior, so that the outermost plug B2 is caused to adhere against the surface of suction guide 5; subsequently, the innermost plug B2 is sucked inwardly to the bottom of the flute, as soon as the flute reaches the suction arc Z. The outermost filter plug B2 is removed by stripper 6 while the innermost filter plug B1 is carried, over the arc Z, again into the hopper zone.

(c) In the flute 101 coming out of hopper 2 there are three filter plugs: B1 (innermost), B2 (outermost) and B3 (intermediate). The innermost plug B1 is held adherent to the bottom of the flute under the action of suction over the arc Z, the outermost plug B2 adheres against the surface of guide 5 and is removed by stripper 6, while the intermediate plug B3 continues its travel again in hopper 2, suitable supporting means being provided for retaining it in the flute over the arc comprised between the stripper 6 and the beginning of the hopper 2. The said supporting means can be constructed as conventional guide means or as the retainer device which will be described after with reference to FIG. 5.

Figure 4:
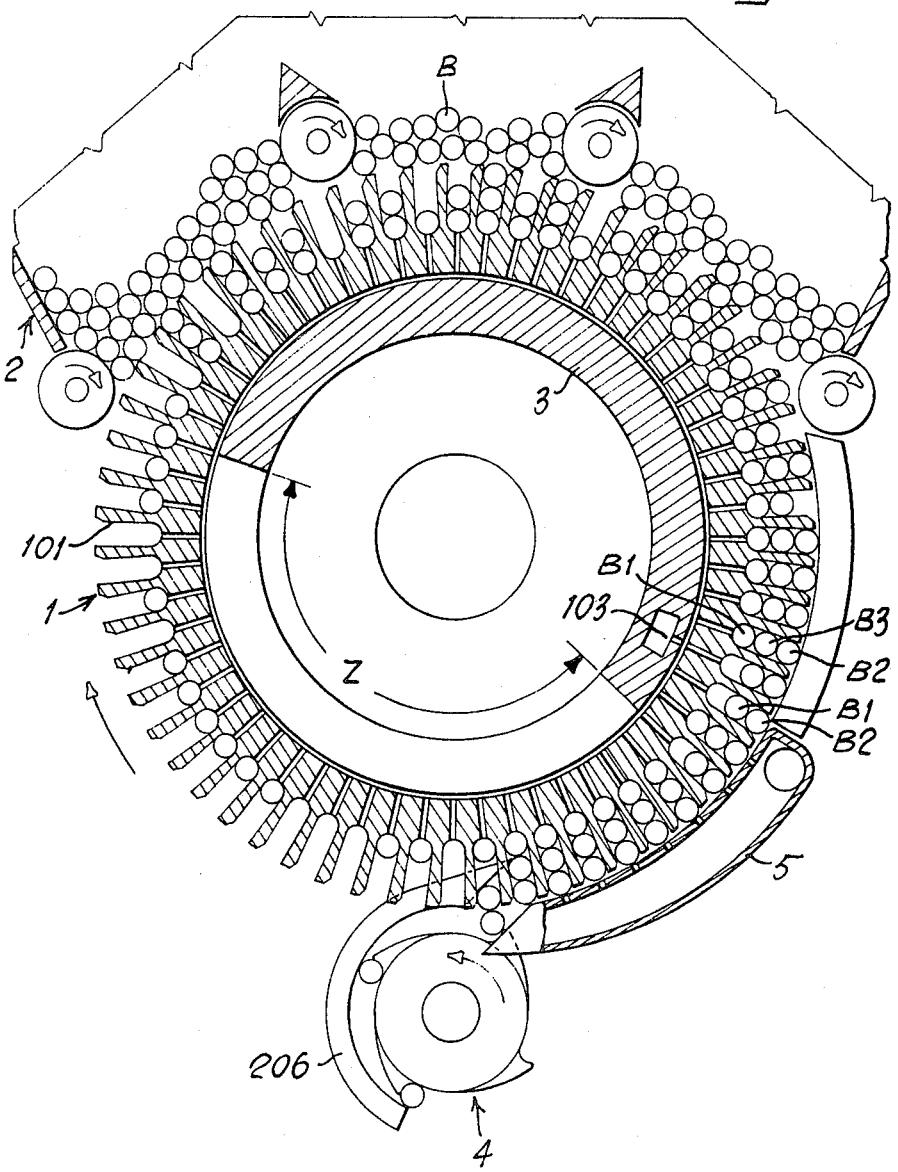

In FIG. 4 there is illustrated still another embodiment, which is identical to the one illustrated in FIG. 4, with the modification consisting in that the stripper 206 removes two plugs from the same flute. In this case, by maintaining unchanged the speed of feed drum 4, the angular speed of drum 1 will be reduced to half, and certainly each flute 101 will pick at least two plugs during its travel in the hopper zone.

Figure 5:
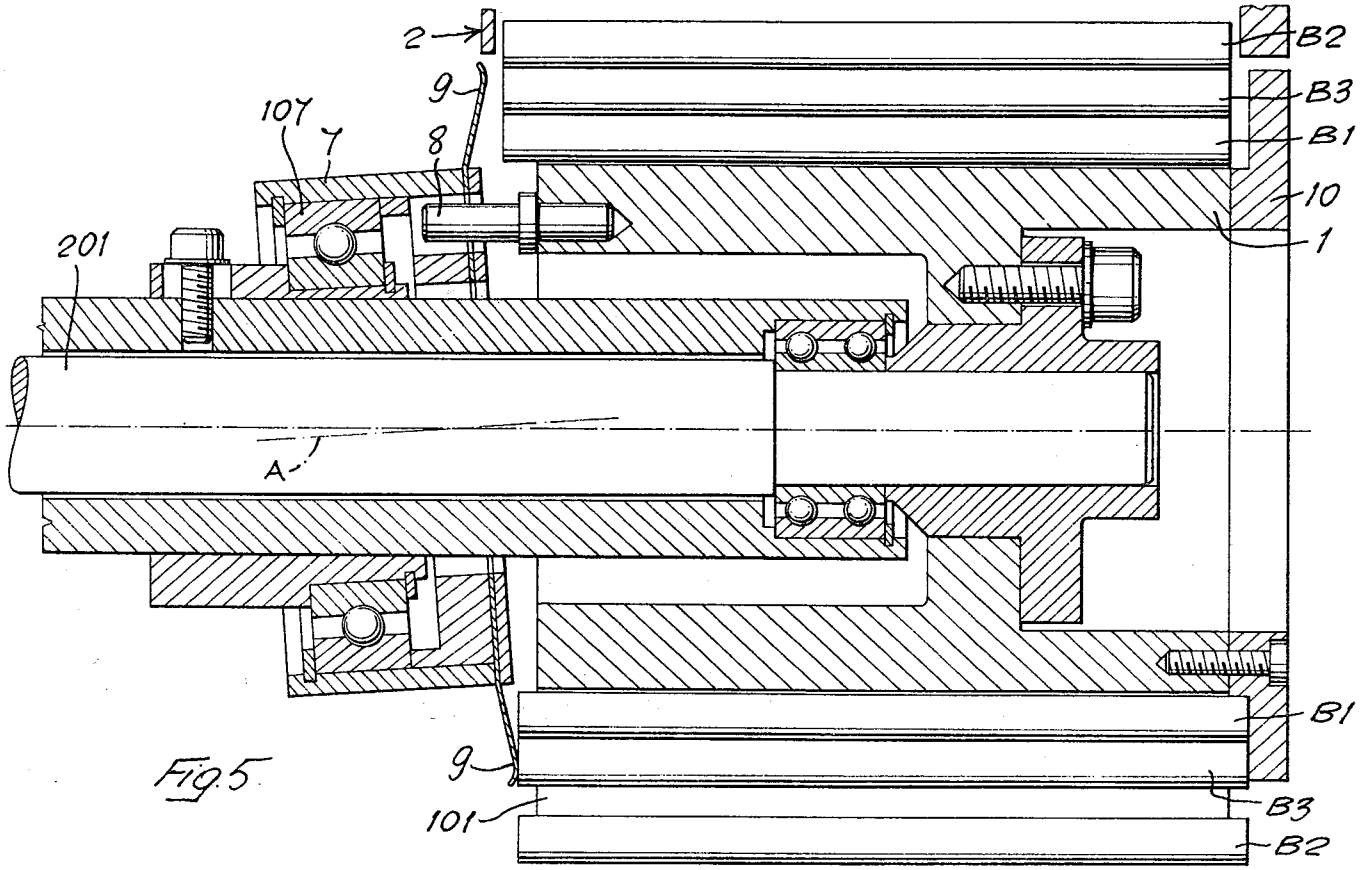
FIG. 5 shows, in longitudinal section, the removal device for holding in the flute the intermediate plug of three superposed plugs.

With reference to FIG. 5, there is illustrated a retainer device for supporting the intermediate filter plugs B3 over the arc between the stripper 6 and the beginning of hopper 2, which retainer device is particularly suitable for use in the embodiment illustrated in FIG. 3.

The retainer device consists of a hub 7, mounted freely rotatable on bearing 107 around the sleeve inside which rotates the shaft 201 of drum 1, with its rotational axis A which is slightly inclined with respect to the rotational axis of the drum 1. The hub 7 is caused to rotate together with the drum 1 by means of a driving pin 8, and is provided circumferentially with a crown of radially projecting blade springs 9, which are equal in number to the flutes 101 of drum 1. As it clearly appears from the drawing, the blade springs 9, during their rotation about axis A, cyclically move towards and away from the side of drum 1, and more particularly, over a predetermined arc of their circular path, they elastically bear against one end of the intermediate filter plug B3 so that the said plug is blocked between the spring 9 at one end and the annular flange 10, integral in rotation with drum 1, at the other end. The hub 7 is arranged, on the sleeve of shaft 201, in such a manner that the springs 9 block the intermediate plugs B3 against the flange 10 over an arc which goes at least from stripper 6 to the beginning of hopper 2.

It is believed that the invention will have been clearly understood from the foregoing detailed description of some preferred embodiments. Changes in the details of construction may be resorted to without departing from the spirit of the invention, and it is accordingly intended that no limitation be implied and that the hereto annexed claims be given the broadest interpretation to which the employed language fairly admits.

I claim:

1. A device for the removal of rod-like articles, such as cigarette filter plugs, from a hopper containing a supply of said articles, said hopper being closed at its bottom by a drum rotating on a horizontal axis and presenting a plurality of peripheral flutes parallel to its axis, transfer means being provided at a point of the circumferential path of the drum located outside of the hopper to transfer the articles housed in the flutes to a feed conveyor operatively coupled with the rotating drum, wherein the improvement consists in that each flute of the rotating drum presents a depth so as to be capable of housing at least two articles arranged parallel to each other and the one above the other in radial direction, and the said transfer means take out at least one article from each flute, and transfer it to the said feed conveyor, there being provided a concave suction guide covering the flutes over an arc immediately prior to the transfer means, whereby either the single article housed in the flute, or the outermost article of at least two articles housed in the flute, is sucked towards the exterior against the concave suction guide, until it reaches the transfer means.

2. A device according to claim 1, in which suction apertures are provided in correspondence of the bottom of each flute, said suction apertures communicating with a suction area over an arc starting after the beginning of the concave suction guide and ending prior to or in correspondence of the beginning of the hopper, having regard to the direction of rotation of the drum, whereby the innermost article of at least two articles housed in a flute is attracted inwardly and held against the bottom of the flute, after that the outermost article has been attracted outwardly by the concave suction guide.

3. A device according to claim 1, in which, having regard to the direction of rotation of the drum, a fixed blow duct is arranged prior to or in correspondence of the beginning of the concave suction guide, said blow duct being adapted to register sequentially with apertures provided in correspondence of the bottom of each flute of the drum, whereby, prior to or simultaneously with the suction directed towards the exterior of the single or outermost article housed in the flute, there is provided a blow of air directed towards the exterior through the bottom of the flute.

4. A device according to claims 1 or 2, in which each flute is designed to house three articles, and the transfer means take out one article for each flute, further comprising mechanical supporting and guide means to retain in the flute the article located intermediately between the innermost and the outermost articles, over an arc from the transfer means to the beginning of the hopper.

5. A device according to claim 1, in which the transfer means for taking out at least one article from each flute and transfer same to the feed conveyer consist of a mechanical stripper.

* * * * *